US006007354A

United States Patent [19]

Watanabe et al.

[11] Patent Number: 6,007,354

[45] Date of Patent: Dec. 28, 1999

[54] CONNECTOR FITTING STRUCTURE AND FITTING METHOD USING THE SAME

[75] Inventors: Hiroshi Watanabe; Takahiko Suzuki; Satoru Murofushi; Kenichi Doshita, all of Shizuoka, Japan

[73] Assignee: Yazaki Corporation, Tokyo, Japan

[21] Appl. No.: 09/126,592

[22] Filed: Jul. 31, 1998

[30] Foreign Application Priority Data

Jul. 31, 1997 [JP] Japan ..... 9-205966

[51] Int. Cl.[6] ..... H01R 13/62

[52] U.S. Cl. ..... 439/157

[58] Field of Search ..... 439/157

[56] References Cited

U.S. PATENT DOCUMENTS

| | | | |
|---|---|---|---|
| 5,810,612 | 9/1998 | Flask et al. | 439/157 |
| 5,857,859 | 1/1999 | Machill et al. | 439/157 |
| 5,876,226 | 3/1999 | Tsukakoshi et al. | 439/157 |

FOREIGN PATENT DOCUMENTS

| | | | |
|---|---|---|---|
| 4-179009 | 6/1992 | Japan | H01H 9/02 |
| 5-114436 | 5/1993 | Japan | H01R 13/629 |
| 5-50114 | 7/1993 | Japan | H01R 13/629 |
| 6-52929 | 2/1994 | Japan | H01R 13/629 |

*Primary Examiner*—Paula Bradley
*Assistant Examiner*—Truc Nguyen
*Attorney, Agent, or Firm*—Sughrue, Mion, Zinn, Macpeak & Seas, PLLC

[57] ABSTRACT

A connector fitting structure comprises a first connector in which an opening is defined by notching a front end portion of one side wall thereof, a second connector fitted with the first connector, an initial fitting member capable of retaining provisionally the second connector inside the first connector, and final fitting means for urging the second connector in a first direction to fit with the first connector, wherein a front end portion of the second connector is inserted from the opening into inside of the first connector along a second direction perpendicular to the first direction and provisionally retained by the initial fitting member, thereafter the second connector is fitted with the first connector by the final fitting means.

11 Claims, 5 Drawing Sheets

CONNECTOR FITTING STRUCTURE AND FITTING METHOD USING THE SAME

BACKGROUND OF THE INVENTION

1. Technical Field of the Invention

The present invention relates to a connector fitting structure and a connector fitting method for fitting a male and a female connector together through the press-fitting operation of a slider after a box body (e.g., auxiliary machinery) is incorporated into a main body (e.g., a vehicle body).

2. Description of Related Art

FIGS. 6 and 7 show a conventional connector fitting structure which is described in Unexamined Japanese Patent Publication No. Hei 5-114436.

As shown in FIG. 6, this structure comprises a box body 42 incorporated into a panel (a vehicle body) 41, a male connector 43 securely mounted inside the box body 42, and a female connector 44 fitted into the male connector 43 from the opposite side of the panel 41. The box body 42 may be an auxiliary machine or the like.

The male connector 43 is provided with a lever 45 capable of pivoting and suitable for fitting the connector in with moderate force, and the female connector 44 is provided with slidable contact projections 46 for engaging with the lever 45. A mating groove 47 for use in operating the lever 45 is formed in the box body 42 as shown in FIG. 7. The male connector 43 is slidable in the fitting direction along rails 48 in the box body 42.

The male connector 43 is provisionally retained in the box body 42, which is then incorporated into the panel 41. The box body 42 is incorporated in the direction in which the connectors are fitted together. When the female connector 44 is pressed against the male connector 43, the lever 45 is pivoted while the male connector 43 is sliding back, whereby the female connector 44 and the male connector 43 are fitted together with moderate force.

The same effect can be achieved in such a way that securing previously the female connector 44 so as to be projected from the panel opening 49, then incorporating the box body 42 into the panel opening 49 and simultaneously pressing the male connector 43 against the female connector 44.

In the aforementioned conventional structure and method, however, there has developed a problem of making the assembling impossible in a case where there exists an interference object (not shown) in the direction of incorporating the box body 42 or where the direction of incorporating the box body 42 is perpendicular to the direction of fitting the connectors 43 and 44 together, since the directions of incorporating the box body 42 and fitting the connectors 43 and 44 together are the same, that is, limited to one.

FIG. 8 shows another fitting structure which is described in Unexamined Japanese Patent Publication No. Hei 4-179009.

This structure is intended to connect a switch contact 56 and an operating unit 57 together without any positional slippage therebetween. In this structure, a circuit board 52 is provided on the dash board 51 so as to be movable within the range of bringing a retaining pin 53 into engagement with a provisional holding hole 54. While the switch contact 56 (one connector) is provided on the circuit board 52, the mating operation unit 57 (the other connector) is provided on a cluster board (a box body) 55. Further, on the cluster board 52, there are provided positioning pins 59 engaging with engaging holes 58 of the dash board 51 and the circuit board 52. According to the structure, since the circuit board 52 is properly positioned simultaneously with that the cluster board 55 is incorporated with the dash board 51 along the direction of connection of the switch contact 56 and the operation unit 57, the switch contact 56 and the operation unit 57 are connected together without any positional slippage.

In the structure, however, it is needed to move the positioning pins 59 and the box body 55 integrally and move the circuit board 52 by means of the positioning pins 59 when the box body 55 is incorporated and when the connectors 56, 57 are fitted together, which has made the incorporating and fitting operations troublesome.

SUMMARY OF THE INVENTION

An object of the present invention made in view of the foregoing problems with the aforementioned conventional structure and method is to provide a connector fitting structure and a connector fitting method wherein the directions of incorporating a box body and fitting connectors together are not restricted and besides the box body needs not moving when the connectors are fitted together.

In order to accomplish the object above, there is provided a connector fitting structure which comprises: a first connector in which an opening is defined by notching a front end portion of one side wall thereof; a second connector fitted with the first connector; an initial fitting member capable of retaining provisionally the second connector inside the first connector; and final fitting means for urging the second connector in a first direction to fit with the first connector, wherein a front end portion of the second connector is inserted from the opening into inside of the first connector along a second direction perpendicular to the first direction and provisionally retained by the initial fitting member, thereafter the second connector is fitted with the first connector by the final fitting means.

In the structure, the initial fitting member includes: a positioning projection provided on front end portion of one side wall of the second connector; and a guide groove extending in the first direction and provided on an inner face of the other side wall of the first connector for engaging with the positioning projection.

In the structure, a tapered face portion is formed in a peripheral portion of the guide groove for introducing the positioning projection.

In the structure, the positioning projection is slidable in the guide groove along the first direction.

In the structure, the final fitting means includes: a slider provided through the other side wall of the first connector and capable of sliding in the second direction; a cam groove formed in one end portion of the slider towarding the one side wall of the first connector; and a slidable engaging member provided in the front portion of the second connector to be inserted into the cam groove.

In the structure, a shape of the cam groove is formed so as to guide the slidable engaging member toward the first connector along the first direction when the slider is slid toward the one side wall of the first connector after the initial fitting.

In the structure, a tapered face portion is formed in an entrance of the cam groove for introducing the slidable engaging member.

In the structure, a groove portion extending in the second direction and capable of receiving the slider is provided in the front end portion of the second connector, and the slidable engaging member is provided in the groove portion at the central portion thereof.

The connector fitting structure further comprises: a first retaining member on which the other side wall of the first connector is secured; and a second retaining member retaining the second connector provisionally, wherein the second retaining member is incorporated with the first retaining member at the time of the initial fitting. The second connector is provisionally retained by an elastic arm provided thereon.

Furthermore, there is also adopted a method for fitting the aforementioned connector fitting structure which comprises the steps of: inserting a front end portion of the second connector together with the second retaining member from the opening into the inside of the first connector along a second direction perpendicular to the first direction; retaining provisionally the second connector inside the first connector by the initial fitting member while incorporating the second retaining member into the first retaining member; releasing the second connector from the second retaining member while urging the second connector toward the first connector along the first direction by the final fitting member; and fitting the second connector with the first connector.

DETAILED DESCRIPTION OF THE PREFERRED EMBODIMENT

A description of preferred embodiment of the present invention will be given below in detail with reference to the accompanying drawings.

Figure 1:
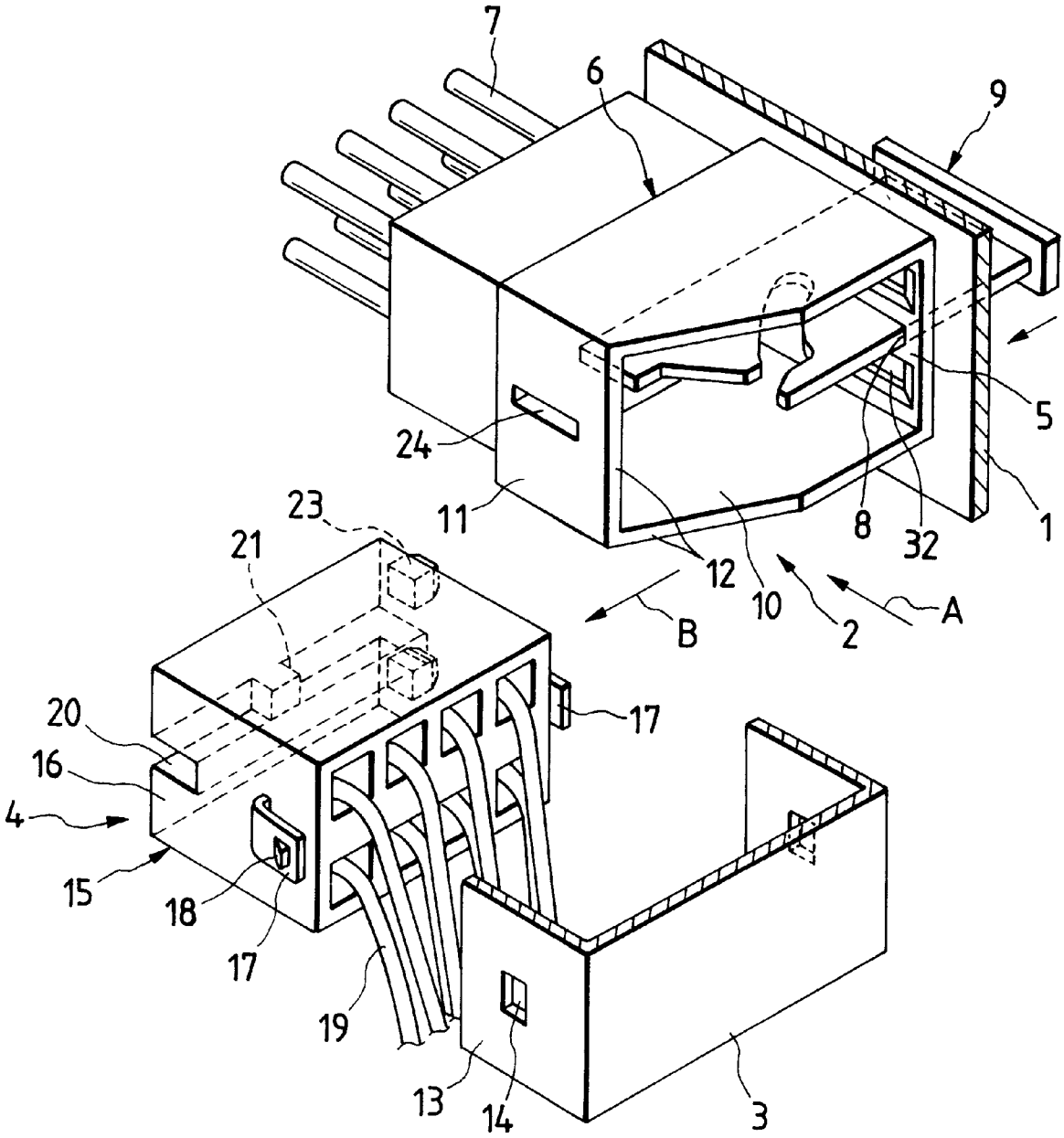
FIG. 1 is an exploded perspective view showing a connector fitting structure of one embodiment according to the present invention.

As shown in FIG. 1, the connector fitting structure comprises a female connector 2 secured to a box body (e.g., auxiliary machinery) 1, and a male connector 4 provisionally held in a vehicle body (e.g., a main body). The box body 1 is incorporated into the vehicle body 3 in a direction (of an arrow B) perpendicular to the direction (of an arrow A) in which the connectors are fitted together, whereby the female connector 2 is integrally moved in the same direction (of the arrow B) and brought into initial engagement with the male connector 4.

One side wall 5 of the female connector 2 is secured to the one side wall of the box body 1 with, for example, rails and a retaining means (which are not shown); that is, the female connector 2 is secured thereto so that it is placed sideways. Male terminals (not shown) are contained in a female connector housing 6 made of synthetic resin and each connected to electric wires 7.

A slit-like slider insertion through hole 8 is provided in the side wall of the box body 1 and the side wall of the female connector housing 6, and a slider 9 is passed through the slider insertion through hole 8. The slider 9 is made to enter the connector fitting chamber 10 of the female connector housing 6. A slit-like slider insertion through hole 24 is also provided in the other side wall 11 of the female connector housing 6.

Further, a tapered opening 12 is formed from the halfway of the other side wall 11 of the female connector housing 6 to the substantial center of the front end of the housing 6. The tapered opening 12 is obliquely opened toward the side of the male connector 4.

On the other hand, a pair of holding walls 13 are bilaterally provided for the vehicle body 3, and a retaining hole 14 for provisionally holding the male connector is provided in each holding wall 13. A pair of elastic retaining arms 17 are also provided in such a manner that the elastic retaining arm 17 is formed on both side walls 16 of a male connector housing 15 made of synthetic resin, and a mating projection 18 for engaging with the retaining hole 14 is projected from the outer side of each elastic retaining arm 17. The mating projection 18 has a tapered face 18*a* on both its longitudinal sides as shown in FIG. 2.

The mating projections 18 are made to engage with the respective retaining holes 14 so that the male connector 4 is provisionally held by the vehicle body 3. Female terminals (not shown) are contained in the male connector housing 15 and connected to electric wires 19, which are led out downward along the front face of the vehicle body 3.

Figure 2:
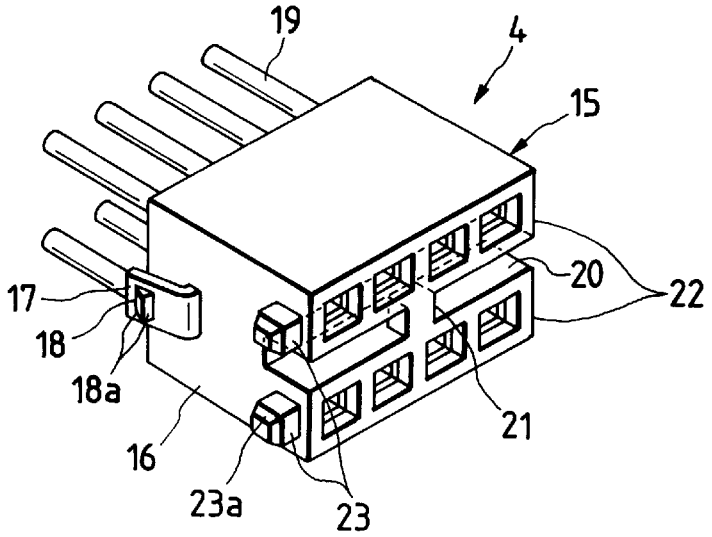
FIG. 2 is a perspective view showing a male connector in the embodiment.

As shown in FIG. 2, an insertion groove 20 with respect to the ffl slider 9 is cut out in the central portion from one side wall 16 to the other side wall 16 of the male connector housing 15. The slider insertion groove 20 communicates with both sides of the front end portion of the male connector housing 15, and a slidable contact mating portion 21 with respect to the slider 9 is formed in the center of the front end portion of the housing. The slidable contact mating portion 21 is in the form of a rectangular pillar and continuous to a terminal chamber portion 22 provided in upper and lower portions of the male connector housing 15.

A pair of positioning projections (pins) 23 are vertically provided closer to the front end of one side wall 16 of the male connector housing 15. Each positioning projection 23 is in the form of a rectangular short pillar with tip end portion thereof having a tapered face 23*a* so as to form a substantially quadrangular pyramid. As shown in FIG. 1, the positioning projections 23 project toward the female connector 2.

Figure 3:
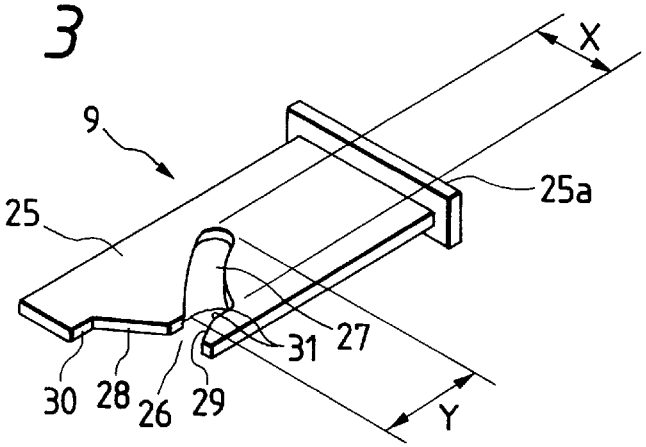
FIG. 3 is s perspective view showing a slider in the embodiment.
Figure 4:
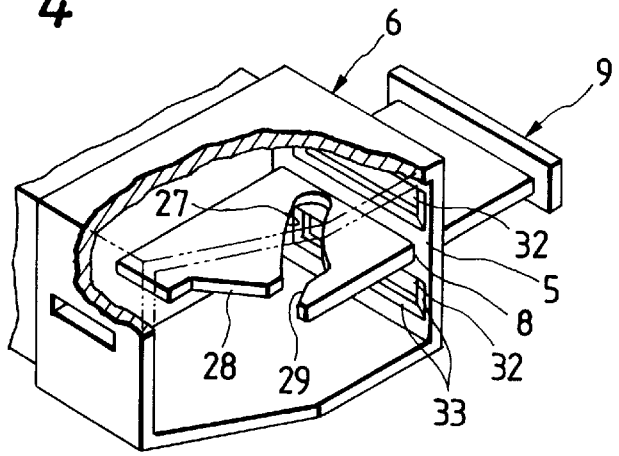
FIG. 4 is a perspective view showing the slider in view from the side in which a female connector is mounted.

As shown in FIGS. 3 and 4, the slider 9 has a horizontal slide plate 25 and an operating portion 25*a* provided in the base portion of the slide plate 25. The slide plate 25 is formed with a approach portion 26 for the slidable contact mating portion 21 of the male connector housing 15 and a cam groove 27 continuous to the approach portion 26.

The approach portion 26 is widely opened and tapered, and has tapered faces 28 and 29 for picking up the slidable contact mating portion 21. The rear tapered face 28 is formed longer than the front tapered face 29 and continuous to a straight face 30 provided in the side of an end portion of the slide plate 25. The tapered faces 28 and 129 are continuous to the cam groove 27 via an intermediate straight face 31. The cam groove 27 is curved backward like a quadratic curve and extended toward the operating portion 25*a*. To facilitate the pressing and pulling operation, the cam groove is formed in such a manner that a slider stroke Y is longer than an engaging stroke X.

As shown in FIG. 4, a pair of guide grooves 32 with respect to the positioning projections 23 of the male connector housing 15 are formed in that portion upper and lower of the slider insertion through hole 8 on the inner face of the one side wall 5 (slider insertion side) of the female connector housing 6. The guide grooves 32 are extended from that portion near the front end of the female connector housing 6 along the direction of fitting the connectors together, and a tapered guide face 33 is formed in the peripheral edge portions of the guide grooves 32.

One end of the guide grooves 32 is positioned closer to the front end of the female connector housing 6 than the slider 9, while the slidable contact mating portion 21 of the male connector housing 15 is positioned closer to the front end thereof than the positioning projections 23. The tapered guide face 33 is used to make the tip end portions of the positioning projections 23 engage with the guide grooves 32 easily and certainly. The positioning projections 23 are movable along the guide grooves 32 in the direction of fitting the connectors together.

Figure 5A:
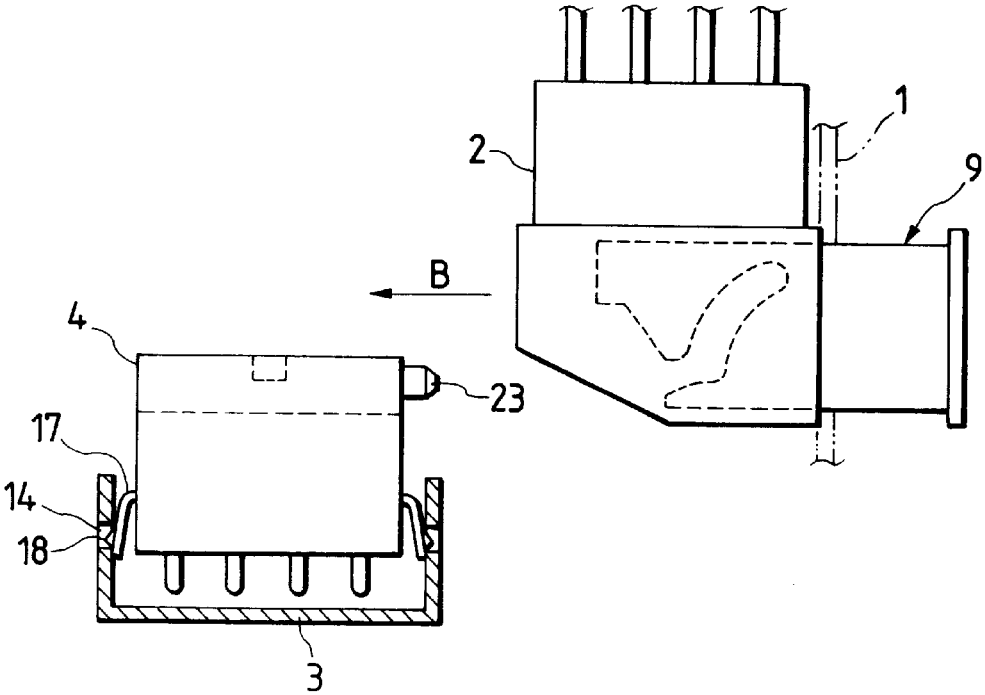
FIGS. 5(*a*)–(*c*) are top views showing a method for fitting the connectors in the embodiment.
Figure 5B:
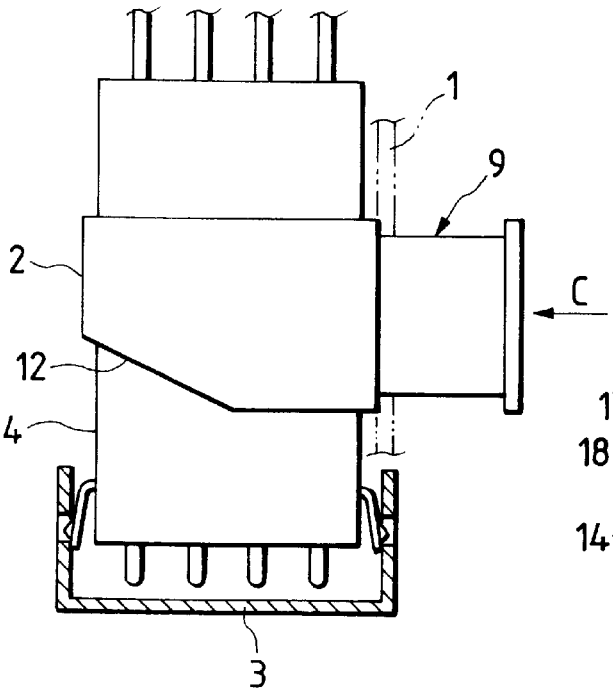
Figure 5C:
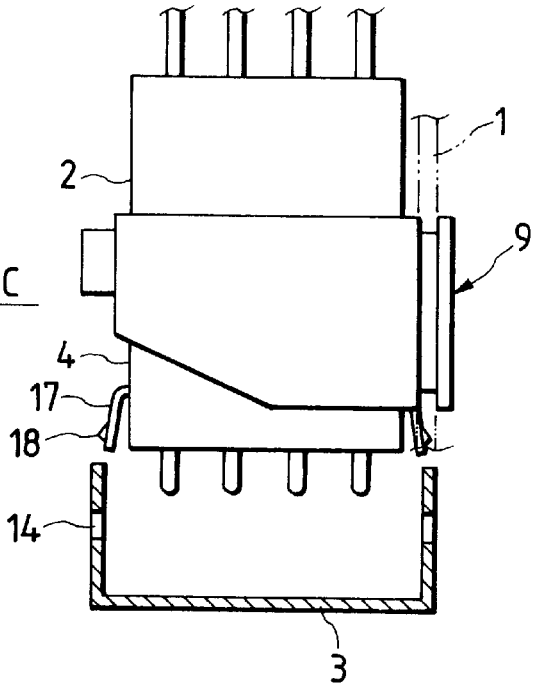
Figure 6:
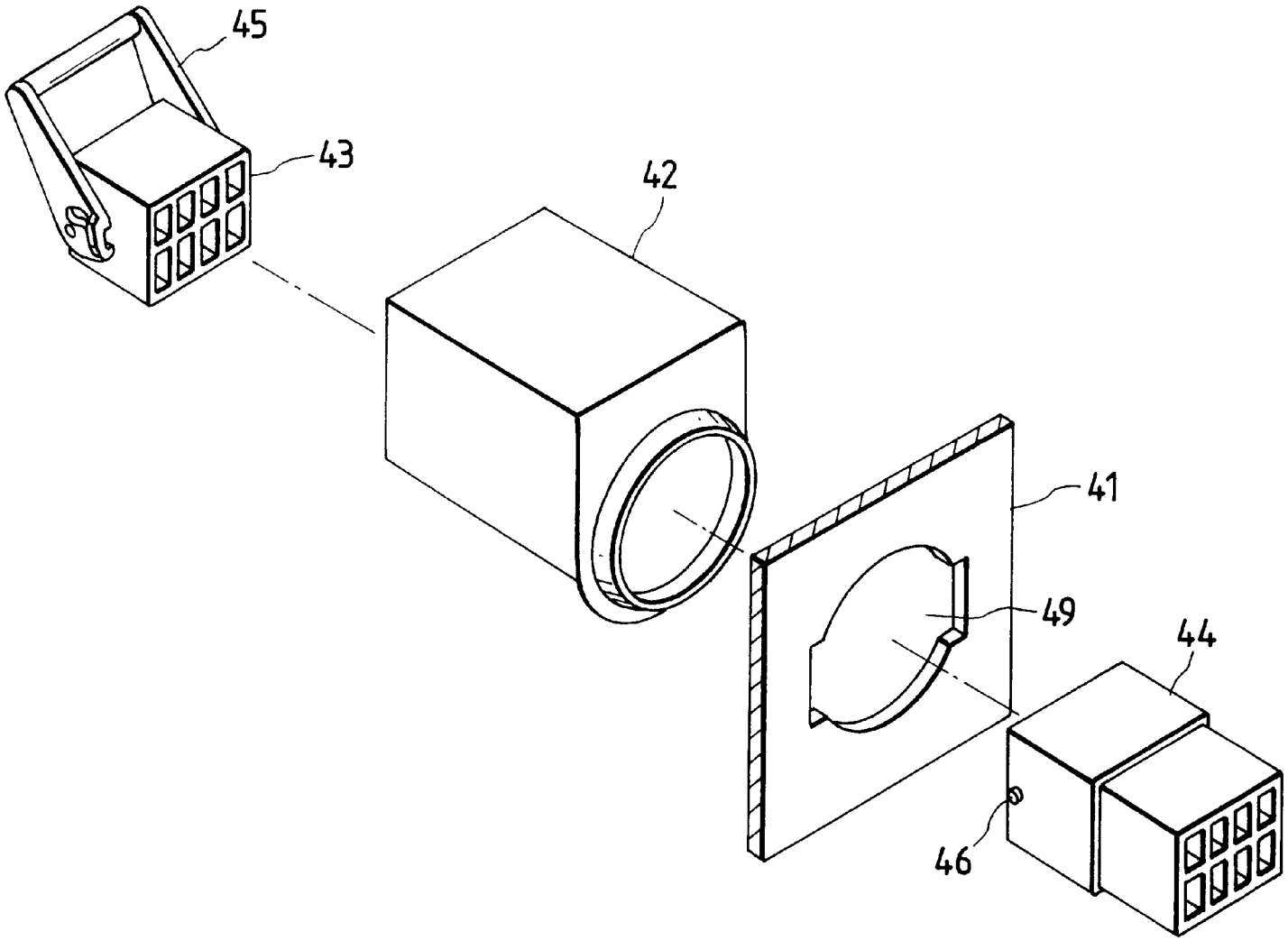
FIG. 6 is an exploded perspective view showing a conventional connector fitting structure.
Figure 7:
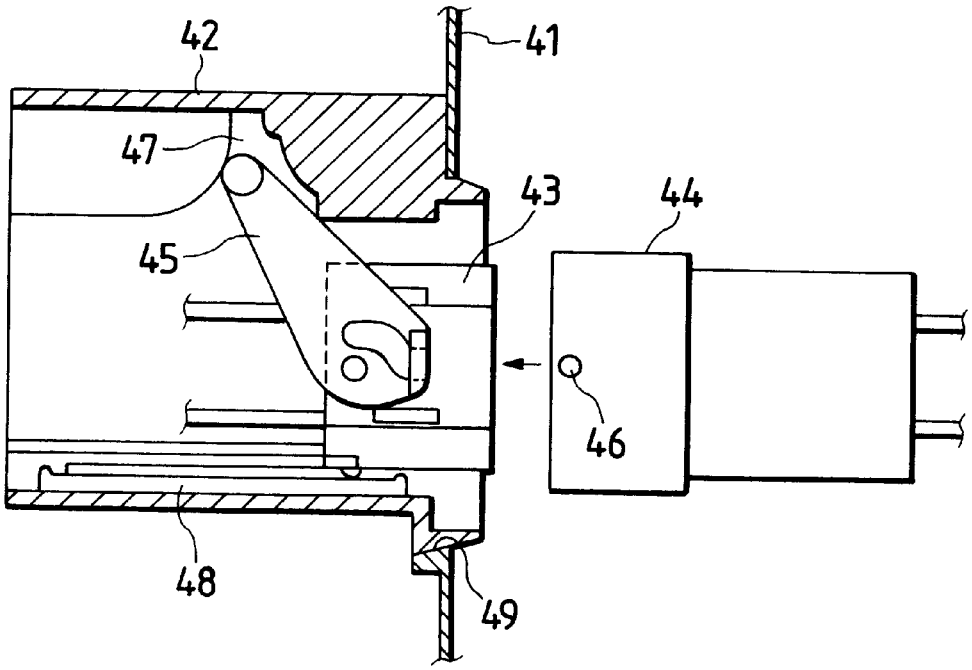
FIG. 7 is a section view showing another conventional connector fitting structure.
Figure 8:
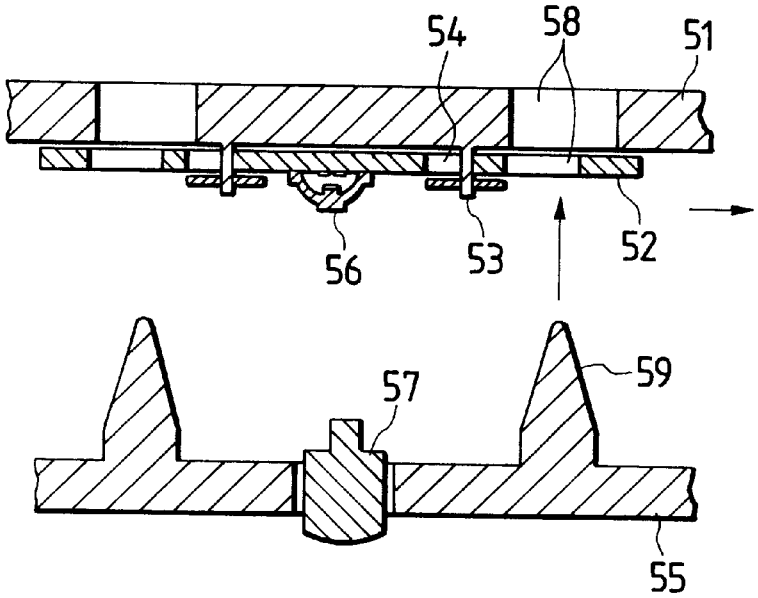
FIG. 8 shows another fitting structure which is described in Unexamined Japanese Patent Publication No. 4-179009.

FIGS. 5(*a*)–(*c*) show a connector fitting method using the connector fitting structure.

First, as shown in FIG. 5(*a*), the elastic retaining arms 17 are made to provisionally hold the male connector 4 in the vehicle body 3. The male connector 4 is held capable of moving bilaterally by the elastic retaining arms 17. Then the female connector 2 together with the box body 1 is moved from the side of male connector 4 in the direction perpendicular to the direction of fitting the connectors together as denoted by the arrow B. The slider 9 is projected from the female connector 2 outwards.

As the box body 1 moves, the male connector 4 is, as shown in FIG. 5(*b*), brought into initial engagement with the entrance side of the connector fitting chamber 10 (FIG. 1) of the female connector 2 from the tapered tapered opening 12 of the female connector 2. At this stage, the positioning projections 23 (FIG. 2) of the male connector 4 mate with the front end sides of the guide grooves 32 of the female connector 2. The terminals of both connectors are not brought into contact with one another yet.

Subsequently, as denoted by an arrow C, the slider 9 is press-fitted in the direction perpendicular to the direction of fitting the connectors together, and the slidable contact mating portion 21 (FIG. 2) of the male connector 4 is picked up by the tapered guide faces 28 and 29 of the slider 9 and guided into the cam groove 27 before being moved along the cam groove 27 toward to female connector 2, that is, in the direction of fitting the connectors together.

Thus, the male connector 4 is drawn to and fitted into the female connector 2 as shown in FIG. 5(*c*). The mating projections 18 of the elastic retaining arms 17 are separated from the retaining holes 14 of the vehicle body 3 and the male connector 4 is released from the vehicle body 3. The slider 9 is passed through the male connector 4 so as to engage with the tapered opening 12 of the other side wall 11 (FIG. 1) of the female connector 2. The female and male connectors 2, 4 are firmly locked by the slider 9.

As shown in FIG. 5(*c*), the slider 9 is passed through the central portion of the male connector 4 and makes the cam groove 27 engage with the slidable contact mating portion 21 in the center of the front end of the male connector 4, whereby the connectors are fitted together smoothly since the moving posture of the male connector 4 is stabilized.

As has been described heretofore, according to the present invention, it can be ensured that the box body is incorporated therein and the connectors are fitted together even though, for example, an interference object exists in the direction of fitting the connectors together since the box body (e.g., auxiliary machinery) can be incorporated into the main body (e.g., vehicle body) in a direction different from the direction of fitting the connectors together.

According to the present invention, the posture of the male connector is stabilized and the connectors are smoothly fitted together since the cam groove of the slider is brought into engagement with the slidable contact mating portion in the center portion of the front end of the male connector.

According to the present invention, it can be ensured that the male connector and the slider are brought into engagement with each other since the slidable contact mating portion is picked up on the tapered guide face.

According to the present invention, the assembling and the fitting operation are simplified without the necessity of moving the box body together with the positioning projections or using the positioning projections for moving the female connector and the box body since the connector is provided with the positioning projections, when the box body is incorporated and when the connectors are fitted together.

According to the present invention, the male and female connectors are aligned simply and precisely since the positioning projections are brought into engagement with the guide grooves simply and surely along the tapered guide face when the connectors are brought into initial engagement with each other.

According to the present invention, the positioning projections are pressed into the guide grooves by the urging force of the elastic retaining arms and the positioning projections are prevented from slipping off the guide grooves to ensure that the alignment of the positioning projections and the guide grooves and that of slidable contact mating portion and the cam groove of the slider are carried out by means of the movement of the elastic retaining arms without any positional slippage.

What is claimed is:

1. A connector fitting structure comprising:

a first connector in which an opening is defined by notching a front end portion of one side wall thereof;

a second connector fitted with the first connector;

an initial fitting member capable of retaining provisionally the second connector inside the first connector; and final fitting means for urging the second connector in a first direction to fit with the first connector, wherein a front end portion of the second connector is inserted from the opening into inside of the first connector along a second direction perpendicular to the first direction and provisionally retained by the initial fitting member, thereafter the second connector is fitted with the first connector by the final fitting means.

2. The fitting connector structure as set forth in claim 1, wherein the initial fitting member includes:

a positioning projection provided on front end portion of one side wall of the second connector; and a guide groove extending in the first direction and provided on an inner face of the other side wall of the first connector for engaging with the positioning projection.

3. The connector fitting structure as set forth in claim 2, wherein a tapered face portion is formed in a peripheral portion of the guide groove for introducing the positioning projection.

4. The fitting connector structure as set forth in claim 2, wherein the positioning projection is slidable in the guide groove along the first direction.

5. The fitting connector structure as set forth in claim 1, wherein the final fitting means includes:

a slider provided through the other side wall of the first connector and capable of sliding in the second direction;

a cam groove formed in one end portion of the slider towarding the one side wall of the first connector; and a slidable engaging member provided in the front portion of the second connector to be inserted into the cam groove.

6. The fitting connector structure as set forth in claim 5, wherein a shape of the cam groove is formed so as to guide the slidable engaging member toward the first connector along the first direction when the slider is slid toward the one side wall of the first connector after the initial fitting.

7. The connector fitting structure as set forth in claim 5, wherein a tapered face portion is formed in an entrance of the cam groove for introducing the slidable engaging member.

8. The connector fitting structure as set forth in claim 5, wherein a groove portion extending in the second direction and capable of receiving the slider is provided in the front end portion of the second connector, and the sidable engaging member is provided in the groove portion at the central portion thereof.

9. The connector fitting structure as set forth in claim 1 further comprising:

a first retaining member on which the other side wall of the first connector is secured; and a second retaining member retaining the second connector provisionally, wherein the second retaining member is incorporated with the first retaining member at the time of the initial fitting.

10. The connector fitting structure as set forth in claim 9, wherein the second connector is provisionally retained by an elastic arm provided thereon.

11. A method for fitting a connector fitting structure which comprises:

a first retaining member;

a second retaining member incorporated with the first retaining member;

a first connector in which an opening is formed by notching a front end portion of one side wall thereof and the other side wall is secured with the first retaining member;

a second connector retained provisionally in the second retaining member;

an initial fitting member capable of retaining provisionally the second connector inside of the first connector; and final fitting means for urging the second connector in a first direction to fit with the first connector, the method comprising the steps of:

inserting a front end portion of the second connector together with the second retaining member from the opening into the inside of the first connector along a second direction perpendicular to the first direction;

retaining provisionally the second connector inside the fast connector by the initial fitting member while incorporating the second retaining member into the first retaining member;

releasing the second connector from the second retaining member while urging the second connector toward the first connector along the first direction by the final fitting member; and fitting the second connector with the first connector.

* * * * *